US012201141B2

(12) United States Patent
Mitrev et al.

(10) Patent No.: US 12,201,141 B2
(45) **Date of Patent: *Jan. 21, 2025**

(54) SMOKING ARTICLE FOR USE WITH AN INTERNAL HEATING ELEMENT

(71) Applicant: Philip Morris Products S.A., Neuchatel (CH)

(72) Inventors: Pande Mitrev, Carouge (CH); Thomas Badertscher, Cernier (CH)

(73) Assignee: Philip Morris Products S.A., Neuchatel (CH)

( * ) Notice: Subject to any disclaimer, the term of this patent is extended or adjusted under 35 U.S.C. 154(b) by 184 days.

This patent is subject to a terminal disclaimer.

(21) Appl. No.: 17/570,940

(22) Filed: Jan. 7, 2022

(65) Prior Publication Data

US 2022/0125099 A1 Apr. 28, 2022

Related U.S. Application Data

(63) Continuation of application No. 14/408,132, filed as application No. PCT/EP2013/062869 on Jun. 20, 2013, now Pat. No. 11,278,052.

(30) Foreign Application Priority Data

Jun. 21, 2012 (EP) ..... 12173054
Mar. 15, 2013 (EP) ..... 13159647

(51) Int. Cl.
*A24D 1/20* (2020.01)
*A24F 40/20* (2020.01)
*A24F 40/46* (2020.01)

(52) U.S. Cl.
CPC ..... *A24D 1/20* (2020.01); *A24F 40/20* (2020.01); *A24F 40/46* (2020.01)

(58) Field of Classification Search
None
See application file for complete search history.

(56) References Cited

U.S. PATENT DOCUMENTS 2,001,709 A 5/1935 Davidson
2,039,298 A 5/1936 Davidson
(Continued)

FOREIGN PATENT DOCUMENTS

CH 649 032 A5 4/1985
CH 670 420 A5 6/1989
(Continued)

OTHER PUBLICATIONS

Official Action (Notice of Hearing) issued in corresponding Indian Patent Application No. 4027/DELNP/14 (with English translation), 3 pages.

(Continued)

*Primary Examiner* — Phu H Nguyen
(74) *Attorney, Agent, or Firm* — Oblon, McClelland, Maier & Neustadt, L.L.P.

(57) ABSTRACT

A smoking article for an aerosol-generating device is provided, including: an aerosol-forming substrate disposed at an extreme upstream end of the article; and a support element disposed immediately downstream of the substrate, the substrate including a gathered crimped sheet of homogenised tobacco material having a plurality of substantially parallel ridges or corrugations extending along or parallel to a longitudinal axis of the article, the tobacco material being penetrable by a heating element of the device having a diameter of between 40 percent and 70 percent of a diameter of the substrate without bending of the article by more than 7 degrees relative to the axis and without tearing or ripping of an outer wrapper of the article, and the support element abuts the substrate and is configured to resist downstream (Continued)

movement of the substrate during insertion of the heating element into the substrate.

11 Claims, 3 Drawing Sheets

(56) References Cited

U.S. PATENT DOCUMENTS 2,164,702 A 7/1939 Davidson
2,827,903 A 3/1958 Niederman
2,852,987 A 9/1958 Eislingen et al.
2,979,058 A 4/1961 Schur
2,992,648 A 7/1961 Weiss et al.
2,995,481 A 8/1961 Müller
3,122,145 A 2/1964 Louis
3,238,852 A 3/1966 Schur et al.
3,240,213 A 3/1966 Miller
3,246,655 A 4/1966 Spears
3,472,236 A 10/1969 Dearsley
3,518,921 A 7/1970 Müller
3,744,497 A 7/1973 Marciuliano
3,818,809 A 6/1974 Sylvester
3,860,012 A 1/1975 Selke
3,894,544 A 7/1975 Egri
3,894,545 A 7/1975 Crellin et al.
3,957,062 A 5/1976 Labbe et al.
3,991,773 A 11/1976 Walker
4,000,748 A 1/1977 Summers
4,003,684 A 1/1977 Müller et al.
4,007,745 A 2/1977 Randall
4,047,536 A 9/1977 Asfour
4,168,712 A 9/1979 Labbé
4,281,671 A 8/1981 Bynre et al.
4,289,725 A 9/1981 Müller et al.
4,291,711 A 9/1981 Berger
4,355,995 A 10/1982 Berger
4,391,285 A 7/1983 Burnett et al.
4,807,808 A 2/1989 Reed
4,807,809 A 2/1989 Pryor et al.
4,819,665 A 4/1989 Roberts
4,903,714 A 2/1990 Barnes et al.
4,913,169 A 4/1990 Templeton
4,922,901 A 5/1990 Brooks
4,928,714 A 5/1990 Shannon
5,016,656 A * 5/1991 McMurtrie ..... A24D 1/02 131/360
5,027,837 A 7/1991 Clearman et al.
5,033,484 A 7/1991 Seidel et al.
5,101,839 A 4/1992 Jakob et al.
5,105,837 A 4/1992 Barnes et al.
5,144,962 A 9/1992 Counts et al.
5,247,947 A 9/1993 Clearman
5,261,425 A 11/1993 Raker et al.
5,271,419 A 12/1993 Arzonico et al.
5,322,075 A 6/1994 Deevi et al.
5,345,955 A 9/1994 Clearman et al.
5,360,023 A 11/1994 Blakley et al.
5,388,594 A 2/1995 Counts et al.
5,413,121 A 5/1995 Dawson et al.
5,433,224 A 7/1995 Luke et al.
5,469,871 A 11/1995 Barnes et al.
5,499,636 A 3/1996 Baggett, Jr. et al.
5,505,214 A 4/1996 Collins et al.
5,613,504 A 3/1997 Collins et al.
5,671,757 A 9/1997 Woodings
5,685,323 A 11/1997 Crooks et al.
5,692,526 A 12/1997 Adams et al.
5,709,227 A 1/1998 Arzonico et al.
5,724,998 A 3/1998 Gellatly et al.
5,819,751 A 10/1998 Barnes et al.
6,026,820 A 2/2000 Baggett, Jr. et al.
6,385,333 B1 5/2002 Puckett et al.
6,761,175 B2 7/2004 Nakanishi et al.
6,857,431 B2 * 2/2005 Deevi ..... A24B 15/286 131/365
7,856,990 B2 12/2010 Crooks et al.
7,998,274 B2 8/2011 Rodrigues et al.
2002/0096300 A1 * 7/2002 Yamashita ..... D01F 2/28 131/332
2003/0154991 A1 8/2003 Fournier et al.
2004/0110633 A1 6/2004 Deevi et al.
2004/0194792 A1 10/2004 Zhuang et al.
2005/0039767 A1 2/2005 Mua et al.
2005/0066985 A1 3/2005 Borschke et al.
2005/0072438 A1 4/2005 Darwish
2005/0172976 A1 8/2005 Newman et al.
2006/0011206 A1 1/2006 Clarke
2006/0021624 A1 2/2006 Gonterman et al.
2006/0185687 A1 8/2006 Hearn et al.
2007/0023056 A1 2/2007 Cantrell et al.
2007/0235050 A1 10/2007 Li et al.
2008/0029114 A1 2/2008 Seitert et al.
2008/0092912 A1 4/2008 Robinson et al.
2008/0163879 A1 7/2008 Rodrigues et al.
2009/0038629 A1 2/2009 Ergle et al.
2009/0044817 A1 2/2009 Besso et al.
2009/0065011 A1 3/2009 Maeder et al.
2009/0301503 A1 12/2009 Peter et al.
2010/0024834 A1 2/2010 Oglesby et al.
2010/0024864 A1 2/2010 Kim et al.
2010/0059070 A1 * 3/2010 Potter ..... A24F 42/60 131/194
2010/0059074 A1 3/2010 Brantley et al.
2010/0154809 A1 6/2010 Seitert et al.
2010/0200006 A1 8/2010 Robinson et al.
2010/0275935 A1 11/2010 Fiebelkorn
2010/0313901 A1 12/2010 Fernando
2011/0036364 A1 2/2011 Pienemann et al.
2011/0036367 A1 2/2011 Saito et al.
2011/0155718 A1 6/2011 Greim et al.
2011/0290269 A1 12/2011 Shimizu
2012/0017925 A1 1/2012 Sebastian et al.
2012/0031414 A1 2/2012 Atchley et al.
2012/0048286 A1 3/2012 Luan et al.
2012/0060853 A1 3/2012 Robinson et al.
2012/0060855 A1 3/2012 Fiebelkorn
2012/0067360 A1 3/2012 Conner et al.
2012/0234821 A1 9/2012 Shimizu
2012/0247494 A1 10/2012 Oglesby et al.
2012/0305015 A1 12/2012 Sebastian et al.
2013/0019886 A1 1/2013 White et al.
2014/0305448 A1 10/2014 Zuber et al.
2015/0027474 A1 1/2015 Zuber et al.

FOREIGN PATENT DOCUMENTS

CH 691 156 A5 5/2001
CN 88 1 01084 A 9/1988
CN 1035040 A 8/1989
CN 1059266 A 3/1992
CN 1190335 A 8/1998
CN 1248888 A 3/2000
CN 1262691 A 8/2000
CN 1316205 A 10/2001
CN 1333657 A 1/2002
CN 1113620 C 7/2003
CN 1633247 A 6/2005
CN 1708241 A 12/2005
CN 1744833 3/2006
CN 1961765 A 5/2007
CN 101094599 A 12/2007
CN 101132823 A 2/2008
CN 101263935 A 9/2008
CN 201127292 Y 10/2008
CN 101351128 A 1/2009
CN 101396173 A 4/2009
CN 101437415 A 5/2009
CN 101500441 A 8/2009
CN 101500442 A 8/2009
CN 101500443 A 8/2009
CN 101631478 A 1/2010
CN 101301111 B 6/2010
CN 101778578 A 7/2010
CN 101790329 A 7/2010

(56) References Cited

FOREIGN PATENT DOCUMENTS

| | | | |
|---|---|---|---|
| CN | 101925309 | A | 12/2010 |
| CN | 101970323 | A | 2/2011 |
| CN | 102088875 | A | 6/2011 |
| CN | 102266121 | A | 12/2011 |
| CN | 102392316 | A | 3/2012 |
| CN | 201379072 | Y | 1/2020 |
| DE | 879823 | C | 6/1953 |
| DE | 1 632 239 | B1 | 3/1972 |
| DE | 198 54 009 | A1 | 5/2000 |
| EP | 0 212 234 | A2 | 3/1987 |
| EP | 0 307 090 | A1 | 3/1989 |
| EP | 0 340 808 | A2 | 11/1989 |
| EP | 0 342 538 | A2 | 11/1989 |
| EP | 0 471 581 | A1 | 2/1992 |
| EP | 0 476 349 | A2 | 3/1992 |
| EP | 0 503 767 | A1 | 9/1992 |
| EP | 0 532 329 | A2 | 3/1993 |
| EP | 0 535 695 | A2 | 4/1993 |
| EP | 0 530 251 | B1 | 9/1995 |
| EP | 0 777 977 | | 6/1997 |
| EP | 0 822 670 | A2 | 2/1998 |
| EP | 0 822 760 | A2 | 2/1998 |
| EP | 0 608 047 | B1 | 7/1998 |
| EP | 1 889 550 | A1 | 2/2008 |
| EP | 2 025 251 | A1 | 2/2009 |
| EP | 2 062 484 | A1 | 5/2009 |
| EP | 2 100 840 | A1 | 9/2009 |
| EP | 2 289 357 | A1 | 3/2011 |
| EP | 2 340 730 | A1 | 7/2011 |
| EP | 2 394 520 | | 12/2011 |
| EP | 2 757 911 | | 7/2014 |
| GB | 793114 | A | 4/1958 |
| GB | 983928 | | 2/1965 |
| GB | 988811 | A | 4/1965 |
| GB | 994169 | A | 6/1965 |
| GB | 866803 | A | 5/1967 |
| GB | 1 124 434 | | 8/1968 |
| GB | 1151634 | A | 5/1969 |
| GB | 1197174 | | 7/1970 |
| GB | 2 020 158 | A | 11/1979 |
| GB | 2 473 264 | A | 3/2011 |
| JP | 50-105896 | A | 8/1975 |
| JP | 51-12999 | | 1/1976 |
| JP | 52-10500 | | 1/1977 |
| JP | 64-71470 | | 3/1989 |
| JP | 1-243979 | A | 9/1989 |
| JP | 2-53476 | A | 2/1990 |
| JP | 05-103836 | A | 4/1993 |
| JP | 5-211861 | A | 8/1993 |
| JP | H05-211861 | | 8/1993 |
| JP | H08-256751 | | 10/1996 |
| JP | 9-103280 | | 4/1997 |
| JP | 9-107942 | A | 4/1997 |
| JP | 9-316420 | A | 12/1997 |
| JP | 11-103839 | A | 4/1999 |
| JP | H11-164679 | | 6/1999 |
| JP | 2002-528106 | A | 9/2002 |
| JP | 2006-504431 | | 2/2006 |
| JP | 2008-525009 | A | 7/2008 |
| JP | 2009-502194 | A | 1/2009 |
| JP | 2009-529871 | | 8/2009 |
| JP | 2010-506594 | | 3/2010 |
| JP | 2010-520742 | | 6/2010 |
| JP | 2010-520764 | A | 6/2010 |
| JP | 2010-178730 | A | 8/2010 |
| JP | 2010-535530 | | 11/2010 |
| JP | 2011-509667 | A | 3/2011 |
| JP | 2011-512853 | A | 4/2011 |
| JP | 2011-115141 | | 6/2011 |
| JP | 2015-517817 | A | 6/2015 |
| JP | 2015-523857 | A | 8/2015 |
| KR | 10-1993-0000048 | A | 1/1993 |
| KR | 1996-0007797 | B1 | 6/1996 |
| KR | 0178388 | | 2/1999 |
| KR | 10-2001-0013020 | | 2/2001 |
| KR | 10-0393327 | B1 | 10/2003 |
| KR | 10-2004-0084899 | A | 10/2004 |
| KR | 10-0636287 | B1 | 10/2006 |
| KR | 10-0844445 | B1 | 7/2008 |
| KR | 10-2009-0046820 | | 5/2009 |
| KR | 10-2010-0054141 | | 5/2010 |
| KR | 10-2010-0121539 | A | 11/2010 |
| KZ | 11053 | | 12/2001 |
| RU | 2 214 141 | C2 | 10/2003 |
| RU | 2 346 629 | C2 | 2/2009 |
| RU | 2 356 458 | C2 | 5/2009 |
| RU | 2008 131 960 | A | 2/2010 |
| RU | 2 410 993 | C2 | 2/2011 |
| TW | 209162 | | 7/1993 |
| TW | 200934399 | A | 8/2009 |
| TW | 200942185 | A1 | 10/2009 |
| TW | 201012400 | A1 | 4/2010 |
| TW | 201043157 | A1 | 12/2010 |
| UA | 88318 | C2 | 10/2009 |
| WO | 94/06314 | A1 | 3/1994 |
| WO | 95/10950 | A2 | 4/1995 |
| WO | 96/32854 | A2 | 10/1996 |
| WO | 96/39880 | A1 | 12/1996 |
| WO | 98/17130 | | 4/1998 |
| WO | 01/89329 | A2 | 11/2001 |
| WO | 2004/041007 | A2 | 5/2004 |
| WO | 2005/032285 | A1 | 4/2005 |
| WO | WO 2006/048774 | A1 | 5/2006 |
| WO | 2007/108877 | A2 | 9/2007 |
| WO | 2008/015441 | A1 | 2/2008 |
| WO | 2008/015570 | A2 | 2/2008 |
| WO | 2008/108889 | A1 | 9/2008 |
| WO | 2009/021018 | A1 | 2/2009 |
| WO | 2009/022232 | A2 | 2/2009 |
| WO | 2009/143338 | A2 | 11/2009 |
| WO | 2010/028354 | A1 | 3/2010 |
| WO | 2010/047389 | A1 | 4/2010 |
| WO | 2010/113702 | A1 | 10/2010 |
| WO | 2011/045066 | A1 | 4/2011 |
| WO | 2011/068020 | A1 | 6/2011 |
| WO | 2011/077138 | A1 | 6/2011 |
| WO | 2011/101164 | A1 | 8/2011 |
| WO | 2011/141735 | A1 | 11/2011 |
| WO | 2012/012053 | A1 | 1/2012 |
| WO | 2012/014490 | A1 | 2/2012 |
| WO | 2012/164009 | A2 | 12/2012 |
| WO | 2013/076098 | A2 | 5/2013 |
| WO | 2013/098353 | A1 | 7/2013 |
| WO | 2013/098405 | A2 | 7/2013 |
| WO | 2013/098409 | A1 | 7/2013 |
| WO | 2013/098410 | A2 | 7/2013 |
| WO | 2013/120565 | A2 | 8/2013 |
| WO | 2013/120566 | A2 | 8/2013 |
| WO | 2013/178766 | A1 | 12/2013 |
| WO | 2013/178767 | A1 | 12/2013 |
| WO | 2013/178768 | A1 | 12/2013 |
| WO | 2013/178769 | A1 | 12/2013 |
| WO | 2014/102092 | A1 | 7/2014 |

OTHER PUBLICATIONS

"Determination of the Draw Resistance of Cigarettes and Filter Rods", Coresta Recommended Method N° 41, Jun. 2007, pp. 1-19.

Office Action issued Mar. 10, 2016 in Chinese Patent Application No. 201280072200.7 (English-language Translation only), 8 pages.

Combined Office Action and Search Report issued Jun. 3, 2016 in Chinese Patent Application No. 201380034575.9 (submitting English translation only), 12 pages.

Combined Chinese Office Action and Search Report issued Jun. 20, 2016 in Patent Application No. 201380034799.X (submitting English translation only), 11 pages.

Combined Chinese Office Action and Search Report issued Jun. 27, 2016 in Patent Application No. 201380034602.2 (submitting English translation only), 11 pages.

Combined Office Action and Search Report issued Jul. 5, 2016 in Chinese Patent Application No. 201380031712.3 (submitting English translation only), 5 pages.

(56) References Cited

OTHER PUBLICATIONS

Combined Search Report and Office Action issued Jan. 4, 2017 in Chinese Patent Application No. 201380031712.3 (English translation only), 7 pages.
Combined Office Action and Search Report issued Feb. 20, 2017 in Chinese Patent Application No. 201380034602.2 (English translation only), 8 pages.
Office Action issued Nov. 13, 2019 in Chinese Application No. 201711346822.5, along with an English translation, 22 pages.
Combined Chinese Office Action and Search Report issued on Dec. 11, 2019, in Patent Application No. 201711347424.5, 21 pages.
Combined Chinese Office Action and Search Report issued Jun. 29, 2020 in corresponding Chinese Patent Application No. 201711346822.5 (with English Translation), 20 pages.
Chinese Office Action issued Jul. 17, 2020 in corresponding Chinese Application No. 201711347424.5 (with English translation), 17 pages.
Extended Search Report issued Oct. 29, 2012 in European patent Application No. 12170358.1, 6 pages.
Extended Search Report issued Oct. 30, 2012, in European Patent Application No. 12170359.9, 6 pages.
Extended Search Report issued Nov. 27, 2012 in European Patent Application No. 12170360.7, 4 pages.
Extended Search Report issued Mar. 19, 2013 in 12170356.5, 8 pages.
Partial Search Report issued Nov. 30, 2012 in European Patent Application No. 12170356.5, 7 pages.
Office Action issued Dec. 11, 2017 in Europe Patent Application No. 13 726 206.9, 5 pages.
International Search Report Issued Sep. 30, 2013 in PCT/EP13/061209 filed May 30, 2013, 6 pages.
International Search Report and Written Opinion issued Sep. 30, 2013 in PCT/EP2013/061210 filed May 30, 2013, 4 pages.
International Search Report issued Oct. 2, 2013, in PCT/2013/061208 Filed May 30, 2013, 2 pages.
International Search Report and Written Opinion issued Oct. 7, 2013 in PCT/EP2013/061211 filed May 30, 2013, 10 pages.
International Search Report issued Oct. 8, 2013, in PCT/EP12/077087 filed Dec. 28, 2012, 8 pages.
International Search Report issued Jan. 24, 2014, in PCT/EP12/077086, filed Dec. 28, 2012, 3 pages.
Written Opinion of the International Searching Authority Issued Sep. 30, 2013 in PCT/EP13/061209 filed May 30, 2013, 3 pages.
Written Opinion issued Oct. 2, 2013 in PCT/EP2013/061208 filed May 30, 2013, 4 pages.
Written Opinion of the International Searching Authority issued Oct. 8, 2013, in PCT/EP12/077087 filed Dec. 28, 2012, 7 pages.
Written Opinion of the International Searching Authority issued Jun. 23, 2014, in PCT/EP12/077086, filed Dec. 28, 2012, 4 pages.
International Preliminary Report on Patentability issued Aug. 14, 2014 in PCT/EP2012/077086, 5 pages.
International Preliminary Report on Patentability (IPRP) issued in PCT/EP2012/077087 on Oct. 29, 2014, 15 pages.
International Preliminary Report on Patentability issued Dec. 2, 2014 in PCT/EP2013/061209 filed May 30, 2013, 4 pages.
International Preliminary Report on Patentability issued Dec. 2, 2014 in PCT/EP2013/061210 filed on May 30, 2013, 4 pages.
International Preliminary Report on Patentability issued Dec. 2, 2014 in PCT/EP2013/061211 filed May 30, 2013, 6 pages.
International Preliminary Report on Patentability issued Dec. 11, 2014 in PCT/EP2013/061208 filed May 30, 2013, 6 pages.
Israeli Office Action with English translation mailed on Mar. 13, 2019 in corresponding Israeli Patent Application No. 235629, 7 pages.
Office Action issued Mar. 29, 2017 in Japanese Patent Application No. 2015-514514 (with unedited computer generated English translation), 7 pages.
Office Action issued Mar. 29, 2017 in Japanese Patent Application No. 2015-514513 (with unedited computer generated English translation), 7 pages.
Office Action issued Mar. 29, 2017 in Japanese Patent Application No. 2015-514511 (with unedited computer generated English translation), 8 pages.
English language translation only of Japanese Office Action mailed on Apr. 17, 2017 in corresponding Japanese Patent Application No. 2015-514512, 5 pages.
Office Action issued Dec. 6, 2017 in Japanese Patent Application No. 2015-514511 (with English language translation) 8 pages.
Japanese Pre-Appeal Review report with English translation mailed on Feb. 27, 2018 in corresponding Japanese Patent Application No. 2015-514514, 4 pages.
Office Action issued Feb. 28, 2018 in Japanese Patent Application No. 2015-514512 (with English language translation), 6 pages.
Japanese Office Action with English translation mailed on Dec. 17, 2018 in corresponding Japanese Patent Application No. 2017-250915, 7 pages.
Japanese Office Action with English translation mailed on Aug. 30, 2019 in corresponding Japanese Patent Application No. 2018-122637, 8 pages.
Office Action issued Aug. 23, 2016 in Kazak Patent Application No. 2014/2552.1 (submitting English translation only), 3 pages.
Notice of Allowance issued Apr. 7, 2016 in Korean Patent Application No. 10-2014-7024000 (English-language Translation only), 1 page.
Korean Notice of Allowance issued Jun. 24, 2020 in corresponding Korean Application No. 10-2014-7033532 (with English translation), 3 pages.
Korean Notice of Allowance issued Jun. 25, 2020 in corresponding Korean Application No. 10-2014-7034539 (with English translation), 3 pages.
Jones, S. 0., "Evaluation of Filter Plugs Prepared From 21-Pound Foil Backing Paper Using the RJR Corrugating Machine" RJ Reynolds, RDM, 1958, No. 70, https://www.industrydocuments.ucsf.edu/lobacco/docs/#id=rzxn0096 (Year: 1958).
Chinese Office Action issued Feb. 23, 2021 in corresponding Chinese Patent Application No. 201810597257.8 (with English translation), 19 pages.
Zhang Huailing, et al., "Blended Type Cigarettes, First Edition", China Light Industry Press, Nov. 30, 1997, 6 pages.
Combined Chinese Office Action and Search Report issued Apr. 1, 2021 in corresponding Chinese Patent Application No. 201910426523.5 (with English translation), 21 pages.
Chinese Office Action issued Jun. 25, 2021, in corresponding Chinese Patent Application No. 201910622233.8 (with English translation), 19 pages.
New Zealand Office Action issued Nov. 10, 2015 in Patent Application No. 703078, 3 pages.
English translation only of Decision to Grant dated Apr. 24, 2017 and received in corresponding Russian Application No. 2014153579/12(085605), 4 pages.
Russian Office Action issued Jun. 8, 2017 in Patent Application No. 2014153639 (with English Translation), 11 pages.
Russian Office Action issued Jun. 23, 2017 in Patent Application No. 2014153008 (with English Translation), 11 pages.
Taiwanese Search Report with English translation mailed on Jul. 10, 2017 in the corresponding Taiwanese Patent Application No. 101151338, 10 pages.
Chinese Office Action issued Jul. 10, 2020 in corresponding Chinese Application No. 201810597257.8 (with English translation), 10 pages.
China Tobacco Yearbook: 1998-1999 (vol. 2) (compiled by the State Tobacco Monopoly Administration, Beijing: The Economic Daily Press, Dec. 2000, pp. 573-574), 3 pages.
International Preliminary Report on Patentability issued Nov. 13, 2014 in PCT/EP213/062869 filed Jun. 20, 2013.
International Search Report issued Nov. 26, 2013 in PCT/EP2013/062869.
Extended Search Report issued Nov. 5, 2012 in European Patent Application No. 12173054.3.
Extended European Search Report issued Dec. 20, 2019 in European Application No. 19189686.9.
Notice of Allowance issued Oct. 31, 2019 in Korean Patent Application No. 10-2014-7012246.

(56) References Cited

OTHER PUBLICATIONS

"Special Filter Rod-Part 1: Acetate Fiber Flute Filter Rod" China Tobacco Industry Standard YC/T 223-1-2007, Jul. 5, 2007, 11 pages (11 pages).
Chinese Office Action issued on Feb. 13, 2018 in Patent Application No. 201380044053.7 with English translation, dated Feb. 13, 2018 (254 pages).
Korean Search Report issued on Dec. 16, 2015 in Patent Application No. 10-2014-7036378.
Office Action issued Sep. 11, 2017 in European Patent Application No. 12 821 115.8.
Office Action issued on Jul. 29, 2016 in Russian Patent Application No. 2015101642/12(002456) (submitting English translation only).
Office Action issued Mar. 22, 2016 in Japanese Patent Application No. 2015-517760 (submitting English translation only).
Korean Office Action issued Apr. 8, 2016 in Patent Application No. 10-2014-7036378 (English translation only).
Combined Office Action and Search Report issued Apr. 19, 2017 in Taiwanese Patent Application No. 102121900 (submitting English translation only).
Combined Chinese Office Action and Search Report issued on Aug. 2, 2016 in Patent Application No. 201380044053.7 (submitting English translation only).
Chinese Office Action received in the corresponding Chinese application No. 201280061528.9 (Date of Notification: May 3, 2017).
Chinese Office Action dated Mar. 8, 2017(English translation only) received in corresponding Chinese Application No. 201280064910.5, (7 pages).
English translation only of Japanese Office Action dispatched on Oct. 17, 2016 in Japanese Patent Application No. JP 2014-549499, (3 pages).
English translation only of Chinese Office Action dated Nov. 25, 2016 in corresponding Chinese Application No. 201280061528.9, ( 4 pages).
International Search Report Issued Jul. 5, 2013 in PCT/EP12/077077 filed Dec. 28, 2012.
Written Opinion of the International Searching Authority Issued Jul. 5, 2013 in PCT/EP12/077077 filed Dec. 28, 2012.
International Search Report issued Feb. 6, 2014 in PCT/EP2012/077092 filed Dec. 28, 2012.
Written Opinion of the International Searching Authority issued Feb. 6, 2014 in PCT/EP2012/077092 filed Dec. 28, 2012.
International Search Report Issued Jun. 11, 2013 in PCT/EP12/077091 filed Dec. 28, 2012.
Written Opinion of the International Searching Authority Issued Jun. 11, 2013 in PCT/EP12/077091 filed Dec. 28, 2012.
Combined Office Action and Search Report issued Jan. 14, 2016 in Chinese Patent Application No. 201280061528.9 (with English translation only).
Office Action issued Dec. 8, 2015 in Kazakhstani Patent Application No. 2014/1655.1 (English translation only).
Combined Office Action and Search Report issued Dec. 14, 2015 in Chinese Patent Application No. 201280061532.5 (English translation only).
Office Action issued Mar. 21, 2015 in Korean Patent Application No. 10-2014-7012121 (with English translation only).
Office Action issued Dec. 9, 2021 in co-pending U.S. Appl. No. 14/402,482, 11 pages.
Combined Chinese Office Action and Search Report issued Dec. 13, 2021 in corresponding Chinese Patent Application No. 201910426523.5 (with English translation), 21 pages.
"Effect of Polyethylene Glycol, Triacetin and Glycerin on the Cellulose Acetate Plasticizing", Korean Polymer Society, vol. 39, No. 4, pp. 649-654 (2015) (R4), http://dx.doi.org/10.7317/pk.2015.39.4.649 (with partial machine English translation), 12 pages.

* cited by examiner

SMOKING ARTICLE FOR USE WITH AN INTERNAL HEATING ELEMENT

CROSS-REFERENCE TO RELATED APPLICATIONS

This application is a continuation application of and claims benefit under 35 U.S.C. § 120 to U.S. application Ser. No. 14/408,132, filed on Dec. 15, 2014, which is a U.S. national stage application of PCT/EP2013/062869, filed on Jun. 20, 2013, and claims benefit of priority under 35 U.S.C. § 119 to EP 13159647.0, filed on Mar. 15, 2013, and EP 12173054.3, filed on Jun. 21, 2012, the entire contents of each of which are incorporated herein by reference.

TECHNICAL FIELD

The present specification relates to a smoking article comprising an aerosol-forming substrate for generating an inhalable aerosol when heated by an internal heating element of an aerosol-generating device. The specification also relates to a method of using such a smoking article.

DESCRIPTION OF THE RELATED ART

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes.

Typically in such heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the user.

A number of prior art documents disclose aerosol-generating devices for consuming or smoking heated smoking articles. Such devices include, for example, electrically heated aerosol-generating devices in which an aerosol is generated by the transfer of heat from one or more electrical heating elements of the aerosol-generating device to the aerosol-forming substrate of a heated smoking article. One advantage of such electric smoking systems is that they significantly reduce sidestream smoke, while permitting a user to selectively suspend and reinitiate smoking.

An example of an electrically heated cigarette used in an electrical smoking system is disclosed in US 2005/0172976 A1. In one embodiment, the electrically heated cigarette comprises a tobacco rod and a filter tipping joined together by tipping paper. The tobacco rod includes a tobacco web folded into a tubular form about a free-flow filter at one end and a tobacco plug at the other end. A void is between the free-flow filter and the tobacco plug. The void is an unfilled portion of the tobacco rod and is in fluid communication with the filter tipping through the free flow filter. The electrically heated cigarette is constructed to be inserted into and a cigarette receiver of a reusable lighter of an electrical smoking system. The lighter includes a power source that supplies energy to a heater fixture including a plurality of electrically resistive heating elements, which are arranged to slidingly receive the cigarette such that the heating elements are positioned alongside the cigarette.

As described above, the electrically heated cigarette disclosed in US 2005/0172976 A1 is for use in an electrical smoking system comprising a plurality of external heating elements. As well as electrical smoking systems comprising aerosol-generating devices with external heating elements, electrical smoking systems comprising aerosol-generating devices with internal heating elements are also known. In use, the internal heating elements of the aerosol-generating devices of such electrical smoking systems are inserted into the aerosol-forming substrate of a heated smoking article such that the internal heating elements are in direct contact with the aerosol-forming substrate.

Direct contact between an internal heating element of an aerosol-generating device and the aerosol-forming substrate of a heated smoking article can provide an efficient means for heating the aerosol-forming substrate to form an inhalable aerosol. In such a configuration, heat from the internal heating element may be conveyed almost instantaneously to at least a portion of the aerosol-forming substrate when the internal heating element is actuated, and this may facilitate the rapid generation of an aerosol. Furthermore, the overall heating energy required to generate an aerosol may be lower than would be the case in a smoking system comprising an external heater element where the aerosol-forming substrate does not directly contact the external heating element and initial heating of the aerosol-forming substrate occurs by convection or radiation. Where an internal heating element of an aerosol-generating device is in direct contact with an aerosol-forming substrate, initial heating of portions of the aerosol-forming substrate that are in direct contact with the internal heating element will be effected by conduction.

However, as well as the potential advantage described above there are also potential disadvantages associated with the use of electric smoking systems comprising aerosol-generating devices with internal heating elements.

During insertion of a heated smoking article into an aerosol-generating device comprising an internal heating element a user may be required to apply significant force in order to overcome the resistance of the aerosol-forming substrate of the heated smoking article to insertion of the internal heating element of the aerosol-generating device. This may damage one or both of the heated smoking article and the internal heating element of the aerosol-generating device.

In addition, the application of significant force during insertion of the internal heating element of the aerosol-generating device into the aerosol-forming substrate of the heated smoking article may displace the aerosol-forming substrate within the heated smoking article. This may result in the internal heating element not being fully inserted into the aerosol-forming substrate, which may lead to uneven and inefficient heating of the aerosol-forming substrate of the heated smoking article.

For example, insertion of an electrically heated cigarette as disclosed in US 2005/0172976 A1 into an aerosol-generating device with an internal heating element will result in displacement of the tobacco plug towards the free flow filter into the void between the free-flow filter and the tobacco plug.

WO2008/015441 discloses a device for delivering volatilised material. The device includes a heat transfer device, such as a heat pipe. In some embodiments the heat transfer device may penetrate a source of volatilizable material such as tobacco.

EP 2 395 520 A1 discloses a non-combustion smoking tool comprising a slender heater having a sharp end which is directly inserted into a commercially available cigarette or cigar to directly heat the tobacco leaves of the cigarette or cigar. EP 2 395 520 A1 discloses that to enable a smoker to smoothly insert the heater into a general filter cigarette having a diameter of 8 mm the diameter of the heater is required to be 2.3 mm or smaller and that attempts to insert heaters having a diameter greater than 2.3 mm into a general filter cigarette having a diameter of 8 mm results in deformation of the outline of the filter cigarette or tearing of the paper of the filter cigarette.

However, while reducing the diameter of an internal heating element as described in EP 2 395 520 A1 facilitates insertion of the internal heating element into the aerosol-forming substrate of a heated smoking article, there are also potential disadvantages associated with the use of electric smoking systems comprising aerosol-generating devices with slender internal heating elements.

Reducing the diameter of the internal heating element relative to the diameter of the aerosol-forming substrate of the heated smoking article adversely affects heat dissipation through the aerosol-forming substrate, which is critical to the generation of a satisfactory aerosol.

SUMMARY

The present specification relates to a smoking article and a method of using a smoking article. In particular, the present specification relates to a smoking article comprising an aerosol-forming substrate for generating an inhalable aerosol when heated by an internal heating element of an aerosol-generating device. The specification also relates to a method of using such a smoking article with an aerosol-generating device comprising an internal heating element.

According to a first aspect, there is provided a smoking article for use in an aerosol-generating device, the smoking article comprising: an aerosol-forming substrate located at an extreme upstream end of the smoking article; and a support element located immediately downstream of the aerosol-forming substrate. The support element abuts the aerosol-forming substrate and the aerosol-forming substrate is configured to be penetrable by a heating element of an aerosol-generating device having a diameter of between about 40 percent and about 70 percent of the diameter of the aerosol-forming substrate without substantial deformation of the smoking article.

According to another aspect, there is provided a method of using a smoking article according to the first aspect with an aerosol-generating device, the method comprising the steps of: inserting a heating element of an aerosol-generating device into the aerosol-forming substrate of the smoking article wherein the heating element has a diameter of between about 40 percent and about 70 percent of the diameter of the aerosol-forming substrate; raising the temperature of the heating element of the aerosol-generating device to heat the aerosol-forming substrate of the smoking article to generate an aerosol; and withdrawing the heating element of the aerosol-generating device from the aerosol-forming substrate of the smoking article.

According to another aspect, there is provided an aerosol-generating system comprising: an aerosol-generating device comprising a heating element; and a smoking article for use with the aerosol-generating device, the smoking article comprising: an aerosol-forming substrate located at an extreme upstream end of the smoking article, wherein the aerosol-forming substrate is penetrable by the heating element of the aerosol-generating device; and a support element located immediately downstream of the aerosol-forming substrate, wherein the support element abuts the aerosol-forming substrate, wherein the heating element of the aerosol-generating device has a diameter of between about 40 percent and about 70 percent of the diameter of the aerosol-forming substrate. The aerosol-forming substrate is configured to be penetrable by the heating element without substantial deformation of the smoking article.

According to a further aspect, there is provided a method of making a smoking article for use in an aerosol-generating device, the method comprising: providing an aerosol-forming substrate; providing a support element immediately downstream of the aerosol-forming substrate; and wrapping the aerosol-forming substrate and the support element in an outer wrapper to form a smoking article such that the aerosol-forming substrate is located at an extreme upstream end of the smoking article and the support element abuts the aerosol-forming substrate. The aerosol-forming substrate is configured to be penetrable by a heating element of an aerosol-generating device having a diameter of between about 40 percent and about 70 percent of the diameter of the aerosol-forming substrate without substantial deformation of the smoking article.

BRIEF DESCRIPTION OF THE DRAWINGS

Specific embodiments will now be described with reference to the figures, in which.

DETAILED DESCRIPTION

Figure 1:
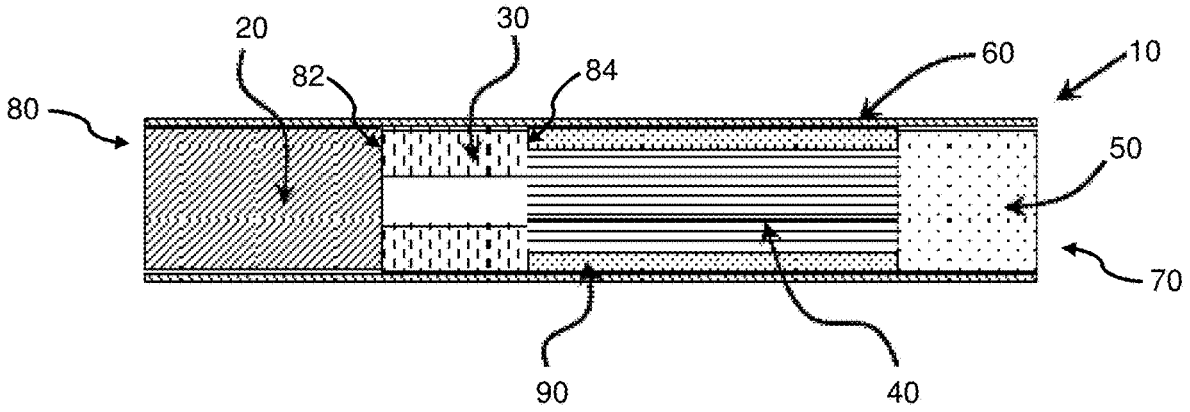
FIG. 1 is a schematic cross-sectional diagram of an embodiment of a smoking article for use with an aerosol generating-device.

As used herein, the term 'aerosol-forming substrate' is used to describe a substrate capable of releasing upon heating volatile compounds, which can form an aerosol. The aerosols generated from aerosol-forming substrates of smoking articles described herein may be visible or invisible and may include vapours (for example, fine particles of substances, which are in a gaseous state, that are ordinarily liquid or solid at room temperature) as well as gases and liquid droplets of condensed vapours.

As used herein, the terms 'upstream', 'downstream', proximal' and 'distal' are used to describe the relative positions of elements, or portions of elements, of smoking articles aerosol-generating devices and aerosol-generating systems according to the invention.

Smoking articles as described herein comprise a proximal end through which in use an aerosol exits the aerosol-generating article. The proximal end may also be referred to as the mouth end. In use, a user draws on the proximal or mouth end of the smoking article in order to inhale an aerosol generated by the smoking article. The smoking article comprises a distal end opposed to the proximal or mouth end. The proximal or mouth end of the smoking article may also be referred to as the downstream end and the distal end of the smoking article may also be referred to as the upstream end. Components, or portions of components, of the smoking article may be described as being upstream or downstream of one another based on their relative positions between the proximal or downstream end and the distal or upstream end of the smoking article.

As used herein the term 'extreme upstream end' is used to describe the outermost or farthest upstream portion of the smoking article.

As used herein the term 'diameter' is used to refer to the maximum transverse dimension of elements, or portions of elements, of smoking articles aerosol-generating devices and aerosol-generating systems according to the invention. For the avoidance of doubt, as used herein the term 'diameter' may refer to the 'width' of elements, or portions of elements, of smoking articles aerosol-generating devices and aerosol-generating systems according to the invention of non-circular transverse cross-section.

As used herein the term 'longitudinal' is used to describe the direction between the downstream or proximal end and opposed upstream or distal end of smoking articles, aerosol-generating devices and aerosol-generating systems according to the invention and the term 'transverse' is used to describe the direction perpendicular to the longitudinal direction.

For the avoidance of doubt, in the following description the term 'heating element' is used to mean one or more heating elements.

Inclusion of a support element immediately downstream of and abutting the aerosol-forming substrate of the smoking article provides a number of advantages.

In preferred embodiments, the support element is configured to resist downstream movement of the aerosol-forming substrate during insertion of the heating element of the aerosol-generating device into the aerosol-forming substrate.

The insertion force experienced by the smoking article as it is inserted into the aerosol-generating device by a user may be divided into three parts: friction force, penetration force and crush force.

As the smoking article is initially inserted into the aerosol-generating device and prior to the heating element of the aerosol-generating device being inserted into the aerosol-forming substrate of the smoking article, the insertion force is dominated by the force required to overcome friction due to interference between the exterior surface of the smoking article and the interior surface of the aerosol-generating device. As used herein, the term 'friction force' is used to describe the maximum insertion force prior to insertion of the heating element of the aerosol-generating device into the aerosol-forming substrate of the smoking article.

As the smoking article is inserted further into the aerosol-generating device and prior to the smoking article reaching a position of maximum insertion, the insertion force is dominated by the force required to overcome resistance of the aerosol-forming substrate of the smoking article to insertion of the internal heating element of the aerosol-generating device.

As used herein, the term 'penetration force' is used to describe the maximum insertion force during insertion of the heating element into the aerosol-forming substrate of the smoking article and prior to the smoking article reaching a position of maximum insertion.

Once the smoking article reaches a point of maximum insertion, the insertion force is dominated by the force required to deform the smoking article. At the position of maximum insertion, the extreme upstream end of the smoking article may come into contact with a surface, for example a bottom or rear surface, of the aerosol-generating device, which prevents the smoking article from being inserted further into the aerosol-generating device.

As used herein, the term 'crush force' is used to describe the maximum insertion force after the smoking article reaches a point of maximum insertion.

The support element of the smoking article resists the penetration force experienced by the smoking article during insertion of the internal heating element of the aerosol-generating device into the aerosol-forming substrate.

The insertion force required to insert a heating element into an aerosol-forming substrate where the heating element has a diameter of between about 40 percent and about 70 percent of the diameter of the aerosol-forming substrate is greater than the insertion force required to insert a heating element into an aerosol-forming substrate where the heating element has a smaller diameter relative to the diameter of the aerosol-forming substrate.

In one embodiment, the support element is configured to resist a penetration force of at least 2.5 N during insertion of the heating element of the aerosol-generating device into the aerosol-forming substrate. The support element may be configured to resist a penetration force of between about 2.5 N and about 10 N during insertion of the heating element of the aerosol-generating device into the aerosol-forming substrate.

In another embodiment, the support element is configured to resist a penetration force of at least 4 N during insertion of the heating element of the aerosol-generating device into the aerosol-forming substrate. The support element may be configured to resist a penetration force of between about 4 N and about 10 N during insertion of the heating element of the aerosol-generating device into the aerosol-forming substrate.

The support element of the smoking article resists downstream movement of the aerosol-forming substrate within the smoking article during insertion of the heating element of the aerosol-generating device into the aerosol-forming substrate.

This may help to ensure that the heating element of the aerosol-generating device fully inserted into the aerosol-forming substrate and so avoid uneven and inefficient heating of the aerosol-forming substrate of the heated smoking article.

In one embodiment, the support element has a fracture force of at least 40 N, for example a fracture force of at least 45 N or at least 50 N. The fracture force is measured by conditioning the support element for at least 24 hours at 22±2 degrees Celsius and 50±5% relative humidity and then compressing the support element to fracture at a constant compression rate using a Instron® 5565 series or equivalent tensile test machine with a 100 N load cell. The test starts when a pre-load of 0.5 MPa is measured and finishes when the load has dropped to 60% of the maximum load. The fracture force is the maximum force recorded during the test.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In one embodiment, the support element may be formed from cellulose acetate.

The support element may comprise a hollow tubular element. In one embodiment, the support element may comprise a hollow cellulose acetate tube.

The support element may have a length of between approximately 5 millimetres and approximately 15 mm, more preferably between approximately 6 millimetres and approximately 10 mm. In one embodiment, the support element has a length of approximately 8 millimetres.

As used herein, the term 'length' is used to describe the dimension in the longitudinal direction of the smoking article.

The support element has an external diameter that is approximately equal to the external diameter of the smoking article.

The support element may have an external diameter of between approximately 5 millimetres and approximately 12 millimetres. In one embodiment, the support element may have an external diameter of approximately 7.2 millimetres.

Where the support element comprises a hollow tubular element, the support element may have an internal diameter of between approximately 3 millimetres and approximately 8 millimetres. In certain embodiments, the support element may have an internal diameter of between approximately 3 millimetres and approximately 4 millimetres. In one embodiment, the support element may have an internal diameter of approximately 3.3 millimetres. In other embodiments, the support element may have an internal diameter of between approximately 6.5 millimetres and approximately 7.5 millimetres. In one embodiment, the support element may have an internal diameter of approximately 6.9 millimetres.

Support elements comprising a hollow tubular element allow volatile compounds released from the aerosol-forming substrate by heat transfer from the heating element of the aerosol-generating device to pass downstream through the hollow tubular element while also resisting downstream movement of the aerosol-forming substrate during insertion of the heating element of the aerosol-generating device into the aerosol-forming substrate Where the support element comprises a hollow tubular element, the velocity of aerosol passing downstream through the support element is dependent on the internal diameter of the hollow tubular element.

As described further below, the smoking article may comprise a transfer element comprising an aerosol-cooling element or heat exchanger located between the support element and a mouthpiece located at the extreme downstream end of the smoking article. The velocity of aerosol passing downstream through the support element may affect the efficiency of heat exchange between the aerosol and the aerosol-cooling element or heat exchanger.

Where the support element comprises a hollow tubular element, the internal diameter of the hollow tubular element may be between about 35 percent and about 98 percent of the external diameter of the hollow tubular element. In certain embodiments, the internal diameter of the hollow tubular element may be between about 35 percent and about 55 percent of the external diameter of the hollow tubular element. In other embodiments, the internal diameter of the hollow tubular element may be between about 90 percent and about 98 percent of the external diameter of the hollow tubular element.

The aerosol-forming substrate is configured to be penetrable by a heating element of an aerosol-generating device having a diameter of between about 40 percent and about 70 percent of the diameter of the aerosol-forming substrate.

The aerosol-forming substrate is configured to be penetrable by a heating element of an aerosol-generating device having a diameter of between about 40 percent and about 70 percent of the diameter of the aerosol-forming substrate without substantial deformation of the smoking article.

As used herein the term 'substantial deformation' is used to describe one or more of bending of the smoking article by more than about 7 degrees relative to the longitudinal axis of the smoking article and tearing or ripping of an outer wrapper of the smoking article.

In preferred embodiments, the support element is resistant to the maximum temperature to which it is exposed at an interface during use of the smoking article in an aerosol-generating device. As used herein the term 'interface' is used to described a plane or point of contact abutting an end of the support element.

In the exemplary embodiment illustrated in FIG. 1, a first interface 82 is the plane between the upstream end of support element 30 and the downstream end of aerosol-forming substrate 20 and a second interface 84 is the plane between the downstream end of support element 30 and the upstream end of transfer section 40.

Figure 5:
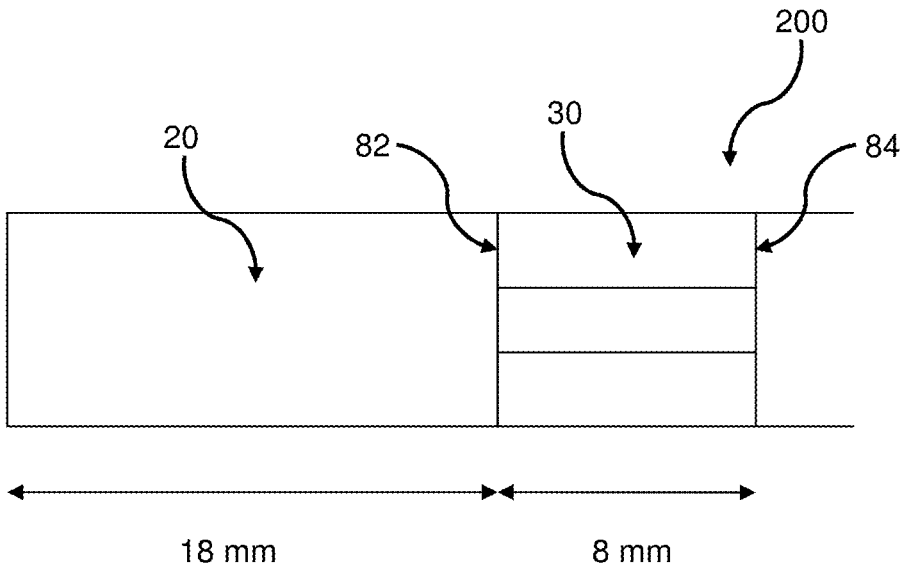
FIG. 5 is a schematic cross-sectional diagram of the aerosol-forming substrate and support element of an embodiment of a smoking article for use with an aerosol generating-device.

In the exemplary embodiment illustrated in FIG. 5, a first interface 82 is the plane between the upstream end of support element 30 and the downstream end of aerosol-forming substrate 20 and a second interface is the plane between the downstream end of support element 30 and the upstream end of the remainder of smoking article 200.

In certain embodiments, the support element is resistant to exposure to a temperature of at least about 100° C. for a period at least about 5 minutes. In preferred embodiments, the support element is resistant to exposure to a temperature of at least about 120° C. for a period at least about 5 minutes. In particularly preferably preferred embodiments, the support element is resistant to exposure to a temperature of at least about 150° C. for a period at least about 6 minutes.

As used herein the term 'resistant to exposure to a temperature' is used to describe a support element that maintains mechanical and structural integrity upon exposure to the specified temperature for a specified period of time. In particular, the term 'resistant to exposure to a temperature' is used to describe a support element that does not ignite, combust, melt, decompose or degrade upon exposure to the specified temperature for a specified period of time.

The aerosol-forming substrate may be a solid aerosol-forming substrate. Alternatively, the aerosol-forming substrate may comprise both solid and liquid components. The aerosol-forming substrate may comprise an aerosol-forming material containing tobacco. Alternatively, the aerosol-forming substrate may comprise a non-tobacco containing aerosol-forming material. The aerosol-forming substrate may further comprise an aerosol former. Examples of suitable aerosol formers include, but are not limited to, glycerine and propylene glycol.

The aerosol-forming substrate may have an aerosol former content of between approximately 5% w/w and approximately 30% w/w. The aerosol-forming substrate may have an aerosol former content of greater than approximately 5% w/w. In one embodiment, the aerosol-forming substrate has an aerosol former content of approximately 20% w/w.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

The solid aerosol-forming substrate may be in the form of a plug comprising an aerosol-forming material circumscribed by a paper or other wrapper and. Where an aerosol-forming substrate is in the form of a plug, the entire plug including any wrapper is considered to be the aerosol-forming substrate.

Optionally, the solid aerosol-forming substrate may contain tobacco or non-tobacco volatile flavour compounds, which are released upon heating of the solid aerosol-forming substrate. The solid aerosol-forming substrate may also contain capsules that, for example, include additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In one embodiment, the aerosol-forming substrate comprises homogenised tobacco material.

As used herein, the term 'homogenised tobacco material' denotes a material formed by agglomerating particulate tobacco.

The aerosol-forming substrate may comprise a gathered sheet of homogenised tobacco material.

As used herein, the term 'sheet' denotes a laminar element having a width and length substantially greater than the thickness thereof.

As used herein, the term 'gathered' is used to describe a sheet that is convoluted, folded, or otherwise compressed or constricted substantially transversely to the longitudinal axis of the smoking article.

The sheet of homogenised tobacco material may be crimped.

As used herein, the term 'crimped' denotes a sheet having a plurality of substantially parallel ridges or corrugations. Preferably, when the smoking article has been assembled, the substantially parallel ridges or corrugations extend along or parallel to the longitudinal axis of the smoking article.

The heating element may be any suitable heating element capable of being inserted into the aerosol-forming substrate of the smoking article. For example, the heating element may be in the form of a pin or blade.

The heating element may have a tapered, pointed or sharpened end to facilitate insertion of the heating element into the aerosol-forming substrate of the smoking article.

The smoking article may be substantially elongate. The smoking article may be substantially cylindrical in shape.

The aerosol-forming substrate may be substantially elongate. The aerosol-forming substrate may be substantially cylindrical in shape.

The smoking article may have a total length of between approximately 30 millimetres and approximately 100 millimetres. In one embodiment, the smoking article has a total length of approximately 45 millimetres.

The smoking article may have an external diameter of between approximately 5 millimetres and approximately 12 millimetres. In one embodiment, the smoking article may have an external diameter of approximately 7.2 millimetres.

The aerosol-forming substrate may have a length of between approximately 7 millimetres and approximately 15 mm. In one embodiment, the aerosol-forming substrate may have a length of approximately 10 millimetres. In an alternative embodiment, the aerosol-forming substrate may have a length of approximately 12 millimetres.

The aerosol-forming substrate preferably has an external diameter that is approximately equal to the external diameter of the smoking article.

The aerosol-forming substrate may have an external diameter of between approximately 5 millimetres and approximately 12 millimetres. In one embodiment, the aerosol-forming substrate may have an external diameter of approximately 7.2 millimetres.

The smoking article may comprise a mouthpiece located at the extreme downstream end of the smoking article. As used herein the term 'extreme downstream end' is used to describe the outermost or farthest downstream portion of the smoking article.

The mouthpiece may comprise a filter. The filter may be formed from one or more suitable filtration materials. Many such filtration materials are known in the art. In one embodiment, the mouthpiece may comprise a filter formed from cellulose acetate tow.

The mouthpiece may have a length of between approximately 5 millimetres and approximately 14 millimetres. In one embodiment, the mouthpiece may have a length of approximately 7 millimetres.

The smoking article may comprise a transfer element or spacer element located downstream of the support element. The transfer element may be located immediately downstream of the support element and abut the support element.

The transfer element may be located between the support element and a mouthpiece located at the extreme downstream end of the smoking article.

The transfer element may have a length of between approximately 5 millimetres and approximately 25 millimetres, more preferably of between approximately 16 millimetres and approximately 22 millimetres. In one embodiment, the transfer element may have a length of approximately 18 millimetres.

The transfer element may comprise an aerosol-cooling element or heat exchanger. The aerosol-cooling element may comprise a plurality of longitudinally extending channels.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In one embodiment, the aerosol-cooling element may comprise a gathered sheet of biodegradable polymeric material, such as polylactic acid or a grade of Mater-Bi® (a commercially available family of starch based copolyesters).

The aerosol-cooling element may have a total surface area of between approximately 300 square millimetres per millimetre length and approximately 1000 square millimetres per millimetre length. In one embodiment, the aerosol-cooling element has a total surface area of approximately 500 square millimetres per millimetre length.

The aerosol-forming substrate and the support element and any other elements of the smoking article may be circumscribed by an outer wrapper. The outer wrapper may be formed from any suitable material or combination of materials. In one embodiment, the outer wrapper is a cigarette paper.

According to another aspect, there is provided a method of using a smoking article in an aerosol-generating device, the smoking article comprising: an aerosol-forming substrate located at an extreme upstream end of the smoking article; and a support element located immediately downstream of the aerosol-forming substrate, wherein the support element abuts the aerosol-forming substrate. The method comprises: inserting a heating element of an aerosol-generating device into the aerosol-forming substrate of the smoking article; raising the temperature of the heating element of the aerosol-generating device to heat the aerosol-forming substrate of the smoking article to generate an aerosol; and withdrawing the heating element of the aerosol-generating device from the aerosol-forming substrate of the smoking article.

According to another aspect, there is provided a method of using an aerosol-generating system, the aerosol-generating system comprising: an aerosol-generating device comprising a heating element; and a smoking article for use with the aerosol-generating device, the smoking article comprising: an aerosol-forming substrate located at an extreme upstream end of the smoking article, wherein the aerosol-forming substrate is penetrable by the heating element of the aerosol-generating device; and a support element located immediately downstream of the aerosol-forming substrate, wherein the support element abuts the aerosol-forming substrate. The method comprises inserting the heating element of the aerosol-generating device into the aerosol-forming substrate of the smoking article; raising the temperature of the heating element of the aerosol-generating device to heat the aerosol-forming substrate of the smoking article to generate an aerosol; and withdrawing the heating element of the aerosol-generating device from the aerosol-forming substrate of the smoking article.

The resistance to draw (RTD) of the smoking article after insertion of the heating element may be between approximately 80 mm WG and approximately 140 mm WG.

As used herein, resistance to draw is expressed with the units of pressure 'mm WG' or 'mm of water gauge' and is measured in accordance with ISO 6565:2002.

Features described in relation to one aspect or embodiment may also be applicable to other aspects and embodiments. For example, features described in relation to smoking articles and systems described above may also be used in conjunction with methods of using smoking articles and systems described above.

FIG. 1 illustrates a smoking article 10 according to an embodiment. The smoking article 10 comprises four elements arranged in coaxial alignment: an aerosol-forming substrate 20, a support element 30, a transfer section 40, and a mouthpiece 50. These four elements are arranged sequentially and are circumscribed by an outer wrapper 60 to form the smoking article 10. The smoking article 10 has a mouth end 70, which a user inserts into his or her mouth during use, and a distal end 80 located at the opposite end of the smoking article 10 to the mouth end 70.

In use air is drawn through the smoking article by a user from the distal end 80 to the mouth end 70. The distal end 80 of the smoking article may thus also be described as the upstream end of the smoking article 10 and the mouth end 70 of the smoking article 10 may also be described as the downstream end of the smoking article 10. Elements of the smoking article 10 located between the mouth end 70 and the distal end 80 can be described as being upstream of the mouth end 70 or, alternatively, downstream of the distal end 80.

The aerosol-forming substrate 20 is located at the extreme distal or upstream end of the smoking article 10. In the embodiment illustrated in FIG. 1, aerosol-forming substrate 20 comprises a gathered sheet of crimped homogenised tobacco material circumscribed by a wrapper. The crimped sheet of homogenised tobacco material comprises comprising glycerine as an aerosol-former.

The support element 30 is located immediately downstream of the aerosol-forming substrate 20 and abuts the aerosol-forming substrate 20 along a first interface 82, which is the plane between the upstream end of support element 30 and the downstream end of aerosol-forming substrate 20.

In the embodiment shown in FIG. 1, the support element is a hollow cellulose acetate tube. The support element 30 locates the aerosol-forming substrate 20 at the extreme distal end 80 of the smoking article 10 so that it can be contacted with an internal heating element of an aerosol-generating device. As described further below, the support element 30 acts to prevent the aerosol-forming substrate 20 from being forced downstream within the smoking article 10 towards the transfer element 40 when an internal heating element of an aerosol-generating device is inserted into the aerosol-forming substrate 20. The support element 30 also acts as a spacer to space the transfer element 40 of the smoking article from the aerosol-forming substrate 20.

The transfer element 40 is located immediately downstream of support element 30 and abuts the support element 30 along a second interface 84, which is the plane between the downstream end of the support element 30 and the upstream end of the transfer element 40. In use, volatile substances released from the aerosol-forming substrate 20 pass along the transfer section 40 towards the mouth end 70 of the smoking article 10. The volatile substances may cool within the transfer section 40 to form an aerosol that is inhaled by the user. In the embodiment illustrated in FIG. 1, the transfer element 40 is an aerosol-cooling element comprising a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the transfer section 40 and abuts the transfer section 40. In the embodiment illustrated in FIG. 1, the mouthpiece 50 comprises a conventional cellulose acetate tow filter of low filtration efficiency.

To assemble the smoking article 10, the four elements described above are aligned and tightly wrapped within the outer wrapper 60. In the embodiment illustrated in FIG. 1, the outer wrapper is a conventional cigarette paper. As shown in FIG. 1, a row of perforations is provided in a region of the outer wrapper 60 circumscribing the support element 30 of the smoking article 10.

The smoking article illustrated in FIG. 1 is designed to engage with an aerosol-generating device comprising an internal heating element in order to be smoked or consumed by a user. In use, the internal heating element of the aerosol-generating device heats the aerosol-forming substrate 20 of the smoking article 10 to a sufficient temperature to form an aerosol, which is drawn downstream through the smoking article 10 and inhaled by the user.

Figure 2:
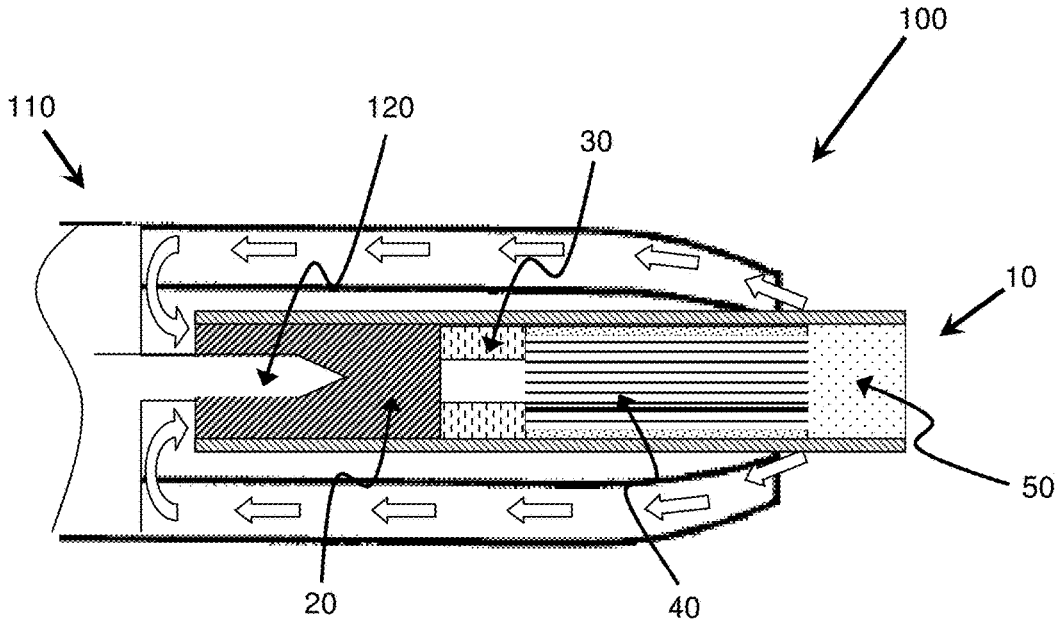
FIG. 2 is a schematic cross-sectional diagram of an embodiment of an aerosol-generating system comprising an aerosol-generating device comprising an internal heating element and a smoking article according to the embodiment illustrated in FIG. 1.

FIG. 2 illustrates a portion of an aerosol-generating system 100 comprising an aerosol-generating device 110 and a smoking article 10 according to the embodiment described above and illustrated in FIG. 1.

The aerosol-generating device comprises an internal heating element 120. As shown in FIG. 2, the heating element 120 is mounted within a smoking article receiving chamber of the aerosol-generating device 100. In use, the user inserts the smoking article 10 into the smoking article receiving chamber of the aerosol-generating device 110 such that the internal heating element 120 is inserted into the aerosol-forming substrate 20 of the smoking article 10 as shown in FIG. 2. In the embodiment shown in FIG. 2, the internal heating element 120 of the aerosol-generating device 110 is a heater blade.

The aerosol-generating device 110 comprises a power supply and electronics (not shown) that allow the internal heating element 120 to be actuated. Such actuation may be manually operated or may occur automatically in response to a user drawing on a smoking article 10 inserted into the smoking article receiving chamber of the aerosol-generating device 110. A plurality of openings is provided in the aerosol-generating device to allow air to flow to the smoking article 10; the direction of air flow is illustrated by arrows in FIG. 2.

Figure 3:
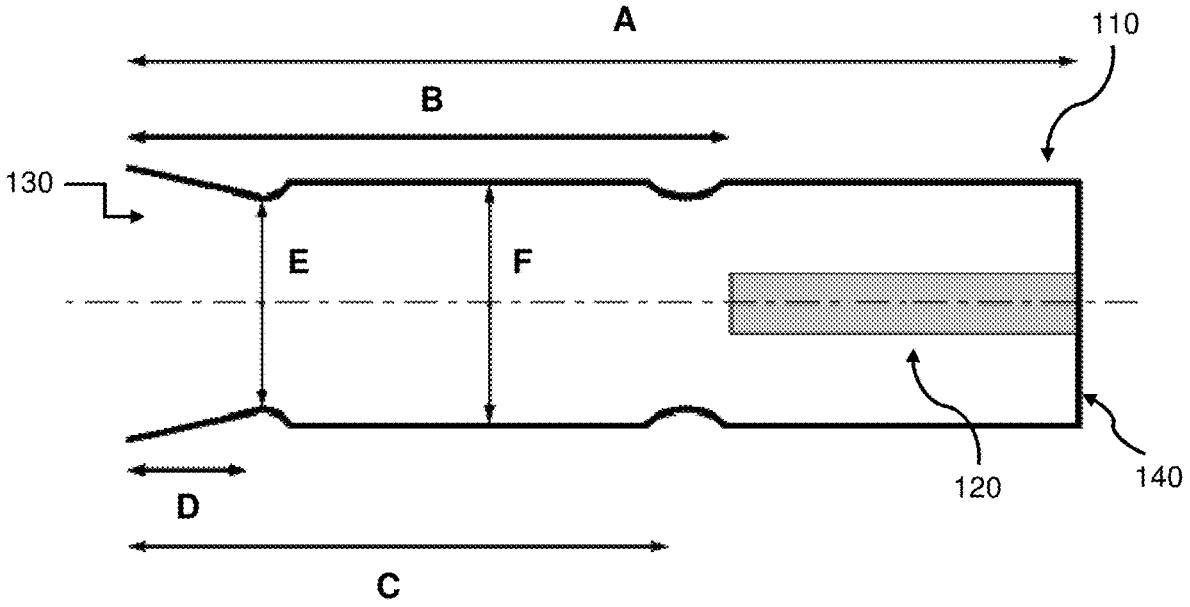
FIG. 3 is a schematic cross-sectional diagram of an embodiment of an aerosol-generating device comprising an internal heating element for use with a smoking article according to the embodiment shown in FIG. 1.

FIG. 3 illustrates an embodiment of an aerosol-generating device 110 comprising an internal heating element 120 for use with the smoking article 10 according to the embodiment described above and illustrated in FIG. 1. The aerosol-generating device 110 comprises a power supply and electronics (not shown) that allow the internal heating element 120 to be actuated. Such actuation may be manually operated or may occur automatically in response to a user drawing on a smoking article inserted into the aerosol-generating device 110. In the embodiment shown in FIG. 3, the internal heating element 120 is a pin heater.

In use, the user inserts the smoking article 10 into an open first end 130 of the aerosol-generating device 110 such that the internal heating element 120 is inserted into the aerosol-forming substrate 20 of the smoking article 10.

As discussed above, the insertion force experienced by the smoking article 10 as it is inserted into the aerosol-generating device 110 by the user is divided into three parts. Firstly, as the smoking article 10 is initially inserted into the aerosol-generating device 110, the smoking article experiences a friction force due to interference between the exterior surface of the smoking article and the interior surface of the aerosol-generating device. Secondly, as the smoking article 10 is inserted further into the aerosol-generating device 110, the smoking article experiences a penetration force due to the insertion of the internal heating element of the aerosol-generating device 110 into the aerosol-forming substrate 20 of the smoking article 10. Finally, as the smoking article 10 is inserted yet further into the aerosol-generating device 110, the smoking article experiences a crush force due to the distal end 80 of the smoking article contacting a closed second end 140 of the aerosol-generating device 110 opposed to the open first end thereof.

The support element 40 of the smoking article 10 resists the penetration force experienced by the smoking article 10 during insertion of the internal heating element 120 of the aerosol-generating device 110 into the aerosol-forming substrate 20. The support element 40 of the smoking article 10 thereby resists downstream movement of the aerosol-forming substrate within the smoking article 10 during insertion of the heating element of the aerosol-generating device into the aerosol-forming substrate.

Once the internal heating element 120 is inserted into the aerosol-forming substrate 10 actuated of the smoking article 10 and actuated, the aerosol-forming substrate 20 of the smoking article 10 is heated to a temperature of about 375 degrees Celsius by the internal heating element 120 of the aerosol-generating device 110. At this temperature, volatile compounds are evolved from the aerosol-forming substrate 20 of the smoking article 10. As a user draws on the mouth end 70 of the smoking article 10, the volatile compounds evolved from the aerosol-forming substrate 20 are drawn downstream through the smoking article 10 and condense to form an aerosol that is drawn through the mouthpiece 50 of the smoking article 10 into the user's mouth.

As the aerosol passes downstream thorough the transfer element 40, the temperature of the aerosol is reduced due to transfer of thermal energy from the aerosol to the aerosol-cooling element. When the aerosol enters the aerosol-cooling element, its temperature is about 60 degrees Celsius. Due to cooling within the aerosol-cooling element, the temperature of the aerosol as it exits the aerosol cooling element is about 40 degrees Celsius.

EXAMPLE

The insertion force required to insert smoking articles according to the embodiment illustrated in FIG. 1 into an aerosol-generating device according to the embodiment shown in FIG. 3 was measured and used to evaluate the friction force, penetration force and crush force experienced by the smoking articles.

Materials & Methods

Materials: Ten smoking articles according to the embodiment illustrated in FIG. 1 with the dimensions given in Table 1 and an aerosol-generating device according to the embodiment illustrated in FIG. 3 with the dimensions labelled A, B, C, D, E and F in FIG. 3 given in Table 2 were used in the measurements.

TABLE 1

| | |
|---|---|
| Length of smoking article (mm) | 45 |
| Diameter of smoking article (mm) | 7.2 |
| Length of aerosol-forming substrate (mm) | 12 |
| Length of support element (mm) | 8 |
| Length of transfer element (mm) | 18 |
| Length of mouthpiece (mm) | 7 |
| Length of outer wrapper (mm) | 45 |

TABLE 2

| | |
|---|---|
| A (mm) | 31.5 |
| B (mm) | 20 |
| C (mm) | 18 |
| D (mm) | 5 |
| E (mm) | 7.3 |
| F (mm) | 8.3 |

Methods: The smoking articles were inserted into the aerosol-generating device through the open first end thereof at a rate of 800 mm/min using an INSTRON 5565 tensile test machine with tailor made clamping equipment. The insertion force as a function of the insertion distance from the open first end of the aerosol-generating device was measured and recorded.

Figure 4:
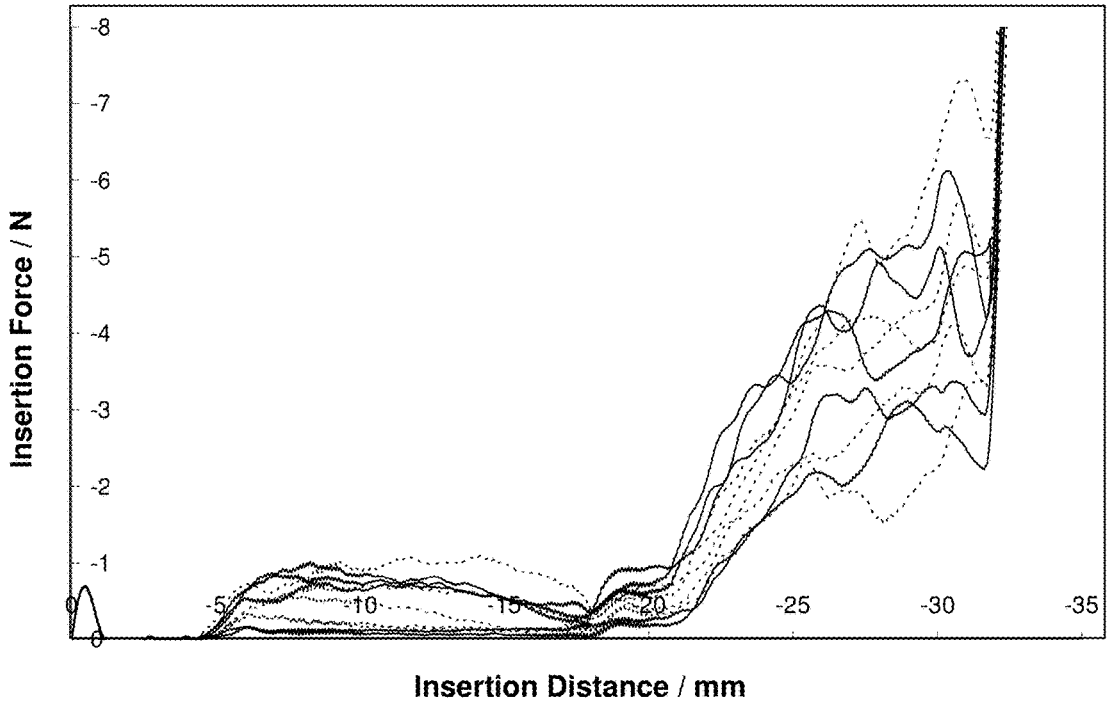
FIG. 4 is a graph showing insertion force as a function of insertion distance during insertion of smoking articles according to the embodiment shown in FIG. 1 into the aerosol-generating device shown in FIG. 3.

Results: FIG. 4 shows a graph of the measured insertion force as a function of the insertion distance for each of the ten smoking articles.

At an insertion distance of 5 mm the smoking articles reach a first constriction in the internal diameter of the aerosol-generating device and the insertion force starts to increase due to friction between the exterior surface of the smoking articles and the interior surface of the cigarette aerosol-generating device as shown in FIG. 4. The friction resulting from the first constriction dominates the insertion force up to an insertion distance of about 18 mm. At this insertion distance, the insertion force decreases slightly before the smoking articles reach a second constriction in the internal diameter of the aerosol-generating device at an insertion distance of 18 mm and the insertion force starts to increase due to friction between the exterior surface of the smoking articles and the interior surface of the cigarette aerosol-generating device.

At an insertion distance of 20 mm, the pin heater of the aerosol-generating device starts to penetrate the smoking article and the insertion force further increases due to the resistance of the aerosol-forming substrate of the smoking article to insertion of the pin heater of the aerosol-generating device. The resistance of the aerosol-forming substrate to insertion of the pin heater dominates the insertion force up to an insertion distance of about 31.5 mm. As shown in FIG. 4, at this insertion distance the insertion force rapidly increases due to the distal or upstream end of the smoking articles contacting the second closed end of the aerosol-generating device. After that the smoking articles start to deform and the insertion force either decreases slightly or continues to increase during deformation of the smoking articles.

For each smoking article measured, the friction force was evaluated as the maximum insertion force measured up to an insertion distance of 20 mm. The average friction force for the ten smoking articles measured is given in Table 3.

For each smoking article measured, the penetration force was evaluated as the maximum insertion force measured up to an insertion distance of 31.5 mm. The average penetration force for the ten smoking articles measured is given in Table 3.

TABLE 3

| Friction Force (N) | | Plug Penetration Force (N) | |
|---|---|---|---|
| Range | Average | Range | Average |
| 0.36-1.02 | 0.70 | 3.1-7.3 | 4.4 |

FIG. 5 illustrates the aerosol-forming substrate 20 and support element 30 of a smoking article 200 according to another embodiment. The aerosol-forming substrate 20 is located at the extreme distal or upstream end of the smoking article 200. In the embodiment illustrated in FIG. 5, the aerosol-forming substrate 20 is 18 millimetres in length and 7.2 millimetres in diameter and comprises a gathered sheet of crimped homogenised tobacco material circumscribed by a wrapper. The crimped sheet of homogenised tobacco material comprises comprising glycerine as an aerosol-former.

Figure 6:
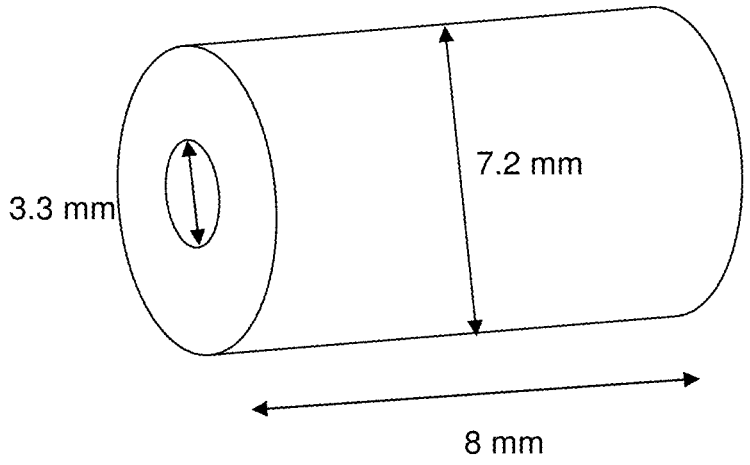
FIG. 6 is a schematic view of the support element of the smoking article according to the embodiment illustrated in FIG. 5.

The support element 30 is located immediately downstream of the aerosol-forming substrate 20 and abuts the aerosol-forming substrate 20 along a first interface 82, which is the plane between the upstream end of support element 30 and the downstream end of aerosol-forming substrate 20. In the embodiment shown in FIG. 5, the support element is a hollow cellulose acetate tube and is 8 millimetres in length. As shown in FIG. 6, the support element has an internal diameter of 3.3 millimetres and an external diameter of 7.2 millimetres.

The support element 30 abuts the remainder of the smoking article 200 along a second interface 84, which is the plane between the downstream end of the support element 30 and the upstream end of the remainder of the smoking article 200.

Although the support elements of the smoking article according to the embodiments described above and illustrated in FIGS. 1 and 6 are formed from cellulose acetate, it will be appreciated that this is not essential and that smoking articles according to other embodiments may comprise support elements formed from other suitable materials or combination of materials.

Similarly, although the smoking article according to the embodiment described above and illustrated in FIG. 1 comprises a transfer element comprising an aerosol-cooling element comprising a crimped and gathered sheet of polylactic acid, it will be appreciated that this is not essential and that smoking articles according to other embodiments may comprise other transfer elements or may not comprise a transfer element.

Furthermore, although the smoking article according to the embodiment described above and illustrated in FIG. 1 has four elements circumscribed by an outer wrapper, it will be appreciated than this is not essential and that smoking articles according to other embodiments may comprise additional elements or fewer elements.

It will also be appreciated that while the four elements of the smoking article according to the embodiment described above and illustrated in FIG. 1 are circumscribed by an outer wrapper of conventional cigarette paper, this is not essential and that the elements of smoking articles according to other embodiments may be circumscribed by other outer wrappers.

It will further be appreciated that dimensions provided for elements of the smoking articles according to the embodiments described above and illustrated in FIGS. 1 and 5 and parts of the aerosol-generating device according to the embodiment described above and illustrated in FIG. 3 are merely exemplary, and that suitable alternative dimensions may be chosen.

The exemplary embodiments described above are not limiting. Other embodiments consistent with the exemplary embodiments described above will be apparent to those skilled in the art.

The invention claimed is:

1. A smoking article for an aerosol-generating device, the smoking article comprising:

an aerosol-forming substrate disposed at an extreme upstream end of the smoking article; and a support element disposed immediately downstream of the aerosol-forming substrate, wherein the aerosol-forming substrate comprises a gathered crimped sheet of homogenised tobacco material having a plurality of substantially parallel ridges or corrugations, the substantially parallel ridges or corrugations extending along or parallel to a longitudinal axis of the smoking article, the tobacco material thereby being configured to be penetrable by a heating element of the aerosol-generating device having a diameter of between 40 percent and 70 percent of a diameter of the aerosol-forming substrate without bending of the smoking article by more than 7 degrees relative to the longitudinal axis of the smoking article and without tearing or ripping of an outer wrapper of the smoking article, and wherein the support element abuts the aerosol-forming substrate, the support element being configured to resist downstream movement of the aerosol-forming substrate during insertion of the heating element of the aerosol-generating device into the aerosol-forming substrate.

2. The smoking article according to claim 1, wherein the support element is further configured to resist a penetration force of at least 2.5 N during insertion of the heating element of the aerosol-generating device into the aerosol-forming substrate.

3. The smoking article according to claim 1, wherein the support element is further configured to resist a penetration force of at least 4 N during insertion of the heating element of the aerosol-generating device into the aerosol-forming substrate.

4. The smoking article according to claim 1, wherein the support element comprises a hollow tubular element.

5. The smoking article according to claim 4, wherein an internal diameter of the hollow tubular element is between 35 percent and 55 percent of an external diameter of the hollow tubular element.

6. The smoking article according to claim 4, wherein the support element further comprises a hollow cellulose acetate tube.

7. The smoking article according to claim 1, wherein the support element is resistant to exposure to a temperature of at least 150° C. for a period at least 6 minutes.

8. The smoking article according to claim 1, further comprising an aerosol-cooling element disposed downstream of the support element.

9. The smoking article according to claim 8, wherein the aerosol-cooling element is disposed immediately downstream of the support element and abuts the support element.

10. The smoking article according to claim 8, wherein the aerosol-cooling element comprises a gathered sheet of biodegradable polymeric material.

11. The smoking article according to claim 1, further comprising a filter disposed at an extreme downstream end of the smoking article.

* * * * *